US010003875B2

(12) United States Patent
Yoshino

(10) Patent No.: US 10,003,875 B2
(45) Date of Patent: Jun. 19, 2018

(54) PHANTOM POWER SUPPLY DEVICE

(71) Applicant: AUDIO-TECHNICA CORPORATION, Machida-shi, Tokyo (JP)

(72) Inventor: Satoshi Yoshino, Machida (JP)

(73) Assignee: AUDIO-TECHNICA CORPORATION, Machida-Shi, Tokyo (JP)

( * ) Notice: Subject to any disclaimer, the term of this patent is extended or adjusted under 35 U.S.C. 154(b) by 0 days. days.

(21) Appl. No.: 15/497,880

(22) Filed: Apr. 26, 2017

(65) Prior Publication Data

US 2018/0007459 A1 Jan. 4, 2018

(30) Foreign Application Priority Data

Jun. 30, 2016 (JP) ..... 2016-130598

(51) Int. Cl.
*H04R 3/00* (2006.01)
*H04R 1/04* (2006.01)

(52) U.S. Cl.
CPC ..... *H04R 1/04* (2013.01); *H04R 3/00* (2013.01); *H04R 3/005* (2013.01)

(58) Field of Classification Search
CPC . H04R 1/04; H04R 3/00; H04R 3/005; H04R 3/007; H04R 19/04; H04R 19/06
USPC ..... 381/111–115, 120, 122, 123, 91, 174; 330/135, 199, 297
See application file for complete search history.

(56) References Cited

U.S. PATENT DOCUMENTS 7,835,531 B2 * 11/2010 Nell ..... H04R 3/00 330/297
8,831,247 B2 * 9/2014 Akino ..... H04R 3/007 381/113
8,873,777 B2 * 10/2014 Yoshino ..... H04R 3/00 381/113

FOREIGN PATENT DOCUMENTS

JP 4528465 B2 8/2010

* cited by examiner

*Primary Examiner* — Xu Mei
(74) *Attorney, Agent, or Firm* — Manabu Kanesaka

(57) ABSTRACT

A phantom power supply device supplies a power supply current to a condenser microphone from a positive terminal of the first DC power supply through a hot and cold supply resistors in the hot and the cold signal line, and includes a remote control switch. A negative terminal, being connected in series to a negative terminal of the first DC power supply in a voltage-adding manner, of the second DC power supply is connected to the switch, and an added voltage of the first and second DC supply is fed to the current drive element on the condenser microphone by an ON operation of the remote control switch. This configuration enables the LEDs connected in series mounted on the condenser microphone to be lit up with enough light emitting luminance even when a low voltage, such as 12 V, is selected as a phantom power supply voltage.

5 Claims, 4 Drawing Sheets

PHANTOM POWER SUPPLY DEVICE

RELATED APPLICATIONS

The present application is based on, and claims priority from, Japanese Application No. JP2016-130598 filed Jun. 30, 2016, the disclosure of which is hereby incorporated by reference herein in its entirety.

BACKGROUND OF THE INVENTION

Field of the Invention

The present invention relates to a phantom power supply device used for condenser microphones, particularly relates to a phantom power supply device enabling clearly lighting and displaying a plurality of light emitters mounted on a condenser microphone, for example, even when the phantom power supply is set at a low supply voltage.

Description of the Related Art

Gooseneck type microphones are well known as conference microphones installed on the announcement tables in a conference room or on the tables of the respective participants in a conference. The gooseneck type microphone includes a stand arm having a flexible pipe capable of easily adjusting its angle or height, and a microphone case housing a microphone unit therein is attached at the tip end of the stand arm.

A small-size and lightweight condenser microphone is used for the gooseneck type microphone. There is employed a phantom power supply device with which operation power is acquired from a microphone amplifier unit such as mixer through signal lines of the microphone in order to operate an impedance converter for the condenser microphone.

Further, some microphones in which a light emitting device is mounted on the microphone case are provided for the microphones installed in a conference room, and the light emitting device employs a bulb or LED, and an LED, which is less in consumed power and preferable in visibility, is actually employed as the light emitting device for such a microphone.

Japanese Patent No. 4528465 discloses the conference microphone for lighting an LED by use of a supply current from the phantom power supply device.

The present applicants have already proposed a conference microphone in which an LED mounted on the microphone case is lit by use of a drive current from the phantom power supply device and the LED can be lit and controlled by a remote operation by an operator by use of a 3-pin type output connector. The conference microphone has been applied as Unexamined Japanese Patent Application No. 2015-36927.

With the conference microphone thus configured, the ON state that an audio signal from the microphone can be taken can be notified to a speaker by the lit LED, thereby smoothly conducting a conference. FIG. 4 illustrates a circuit configuration of a conference microphone previously proposed by the present applicants.

A microphone unit 2 provided in a microphone 1 employs an electret condenser microphone unit having a diaphragm and a fixed electrode that oppose to each other, any one of which has an electret layer.

The fixed electrode is connected to a gate of a FET (Q1) functioning as an impedance converter, and a conductive film formed on the diaphragm is connected to a ground line of the microphone 1. A drain of the FET (Q1) is supplied with a DC operating voltage from a constant voltage circuit described below and a source of the FET is connected with a source resistor R1 so that the FET (Q1) constitutes a source follower circuit.

A coupling capacitor C1 is connected to the source of the FET (Q1), and an impedance-converted signal from the condenser microphone unit 2 is extracted through the coupling capacitor C1.

The signal is supplied to a non-inverting input terminal of a first operational amplifier OP1. An input resistor R2 of a second operational amplifier OP2 is connected to an output terminal of the first operational amplifier OP1, and the other end of the input resistor R2 is connected to an inverting input terminal of the second operational amplifier OP2.

A non-inverting input terminal of the second operational amplifier OP2 is connected to the ground through a capacitor C2. A feedback resistor R3 is connected between the non-inverting input terminal and the output terminal of the second operational amplifier OP2, and the values of the input resistor R2 and the feedback resistor R3 are set to be equal so that the second operational amplifier OP2 functions as an inverting amplifier with an amplification factor of −1.

Thus, the output of the first operational amplifier OP1 and the output of the second operational amplifier OP2 are generated on the basis of a signal acquired by the condenser microphone unit 2 to be in a reverse phase to each other (in a balanced output state). The balanced-output signals are supplied to the bases of the transistors Q2 and Q3 through the coupling capacitors C3 and C4, respectively.

The transistor Q2 constitutes a first emitter follower circuit including a bias setting resistor R4. An output of the first emitter follower circuit is supplied as signal hot output to a second pin P2 of an output connector 3. The transistor Q3 constitutes a second emitter follower circuit including a bias setting resistor R5. An output of the second emitter follower circuit is supplied as signal cold output to a third pin P3 of the output connector 3.

A supply current from a phantom power supply device (not shown) provided in a microphone amplifier unit 11 is equally divided into the hot side and the cold side to be sent to the microphone 1 through the second pin P2 and the third pin P3 of the output connector 3 for outputting a balanced audio signal.

A DC current from the phantom power supply device is supplied to coupled collectors of the transistors Q2 and Q3 constituting the first and second emitter follower circuits. The coupled collectors are connected to a current regulative diode CR1. A Zener diode ZD as constant voltage device and a capacitor C5 are connected in parallel between the current regulated diode CR1 and the ground line. The Zener diode ZD and the capacitor C5 constitute a constant voltage circuit 4, which supplies a drive voltage to the FET (Q1) and the first and second operational amplifiers OP1 and OP2.

Meanwhile, an LED (D1) as light emitter is mounted on the condenser microphone 1 as illustrated in FIG. 4. The anode of the LED (D1) is connected to the constant voltage circuit 4 and the cathode is connected to a first pin P1 of the output connector 3.

As illustrated in FIG. 4, both the output connector 3 in the microphone 1 and a connector 12 in the microphone amplifier unit 11 employ a 3-pin type connector, and are connected to each other with a well-known balanced shield cable including a hot signal line (HL) and a cold signal line (CL). A frame ground terminal SI is connected through a ground connection line.

A switch SW provided in the microphone amplifier unit 11 is to remotely perform an ON/OFF operation of the LED (D1) mounted on the microphone 1 from the microphone amplifier unit 11 side. That is, when the switch SW connected to a first pin P1 of the connector 12 is turned ON, the cathode of the LED (D1) is connected to the ground and the LED (D1) is lit by the phantom power supply, and when the switch SW is turned OFF, the LED (D1) is turned off.

SUMMARY OF THE INVENTION

The phantom power supply device provided in the microphone amplifier unit 11 is defined in the EIAJ standard (RC-8162A) such that its supply voltage has three types of 12 V, 24 V, and 48 V and a power supply resistance of 680Ω, 1.2 kΩ, or 6.8 kΩ is used, respectively, according to the supply voltage.

In some cases the phantom power supply device may need to use a battery depending on a facility, then, the lowest voltage of 12 V may need to be selected as supply voltage by the phantom power supply device. Though it might be assumed that a battery output voltage of 12 V is boosted with a DC-DC converter, for example, to supply 48 V, this may cause a problem of restriction to be imposed on a continuous use time of the battery. Due to such a reason, there may be concluded in many cases that only the lowest voltage of 12 V has to be selected as supply voltage according to the standard.

Meanwhile, there is provided a microphone including a plurality of LEDs in order to increase luminance for clear display. In this case, when four red LEDs are provided in series, for example, a total voltage drop of the four LEDs is 2V*4=8V if assumed that a forward voltage, a voltage across the LED when turned ON and lit, of 2 V per LED.

Therefore, when a phantom power supply voltage of 12 V is used, supplied power to the impedance conversion circuit including the FET (Q1) illustrated in FIG. 4 or the balanced output circuit including the two operational amplifiers OP1 and OP2 is not enough, and accordingly the microphone may fail to operate.

It is therefore an object of the present invention to provide a phantom power supply device that is capable of lighting a plurality of LEDs, for example, mounted on a condenser microphone with sufficient light emitting luminance, and of operating an audio signal processing circuit including the impedance conversion circuit or the balanced output circuit with predetermined performance, even when a low voltage such as 12 V is selected for the phantom power supply voltage.

A phantom power supply device according to the present invention for solving the problem, supplying power to a condenser microphone from which an audio signal is outputted through a balanced line having a hot signal line (HL) and a cold signal line (CL), the phantom power supply device including: a remote operation switch that supplies a power supply current from a positive terminal of a first DC power supply to the condenser microphone through the hot signal line (HL) and the cold signal line (CL) through a hot supply resistor and a cold supply resistor, respectively, and controls a current drive device mounted on the condenser microphone to be conducted, wherein the remote operation switch is connected with a negative terminal of a second DC power supply connected in series to the negative terminal of the first DC power supply in a voltage-adding manner, and an added voltage of the first DC power supply and the second DC power supply is supplied to the current drive device mounted on the condenser microphone by an ON operation of the remote control switch.

In this case, in a preferred form, the second DC power supply is generated from the first DC power supply by use of a voltage converter IC (preferably inverting-type charge pump).

Meanwhile, the current drive device mounted on the condenser microphone is a light emitting display in which a plurality of LEDs are connected in series, and the added voltage of the first DC power supply and the second DC power supply is supplied to the LEDs connected in series when the remote operation switch is turned ON.

With the phantom power supply device according to the present invention, a current from the first DC power supply is fed to the condenser microphone in the hot signal line (HL) and the cold signal line (CL) thereby to operate the audio signal processing circuit including the impedance converter with predetermined performance.

When the power is fed to the current drive device mounted on the condenser microphone, such as a light emitter of LEDs connected in series, through the remote operation switch, an added voltage of the first DC power supply and the second DC power supply is applied to the LEDs.

Therefore, even when a low value (such as 12 V) is selected for the phantom power supply voltage (the first DC power supply), a sufficient light emitting drive voltage can be applied to the light emitter of LEDs, thereby clearly lighting the light emitter of LEDs with sufficient light emitting luminance.

In this case, the second DC power supply can be easily prepared from the first DC power supply by use of an inverting type charge pump as a general-purpose voltage converter IC, for example. Therefore, it is possible to provide a condenser microphone with high marketability and a phantom power supply device for driving the condenser microphone without causing an increase in cost.

DESCRIPTION OF THE PREFERRED EMBODIMENTS

Figure 1:
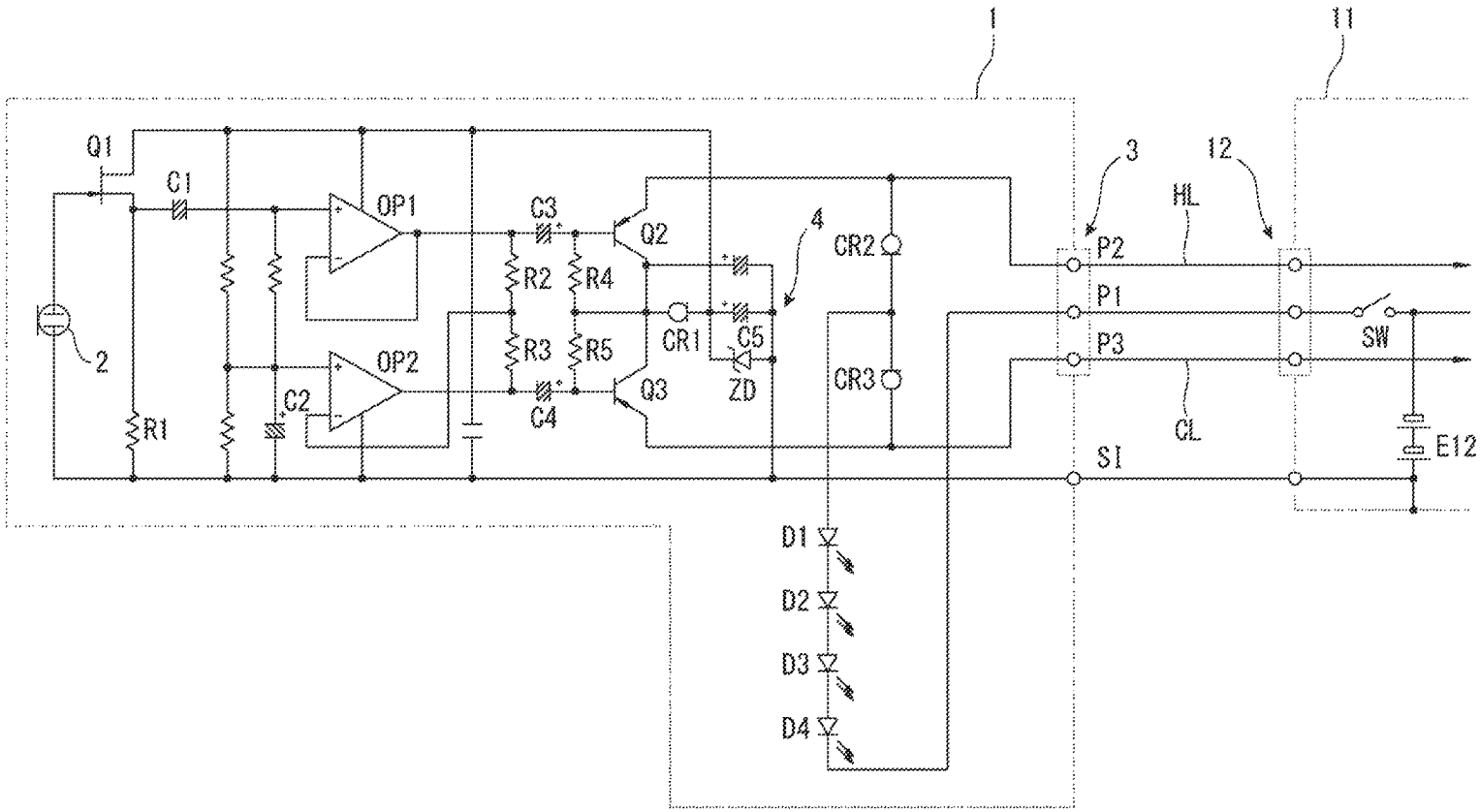
FIG. 1 is a circuit configuration diagram of a condenser microphone used with a phantom power supply device according to the present invention.

FIG. 1 illustrates a preferred example of a condenser microphone capable of taking full advantage of a display function of an LED light emitter together with a phantom power supply device according to the present invention. Firstly, the condenser microphone illustrated in FIG. 1 will be explained before describing the phantom power supply device according to the present invention.

Figure 4:
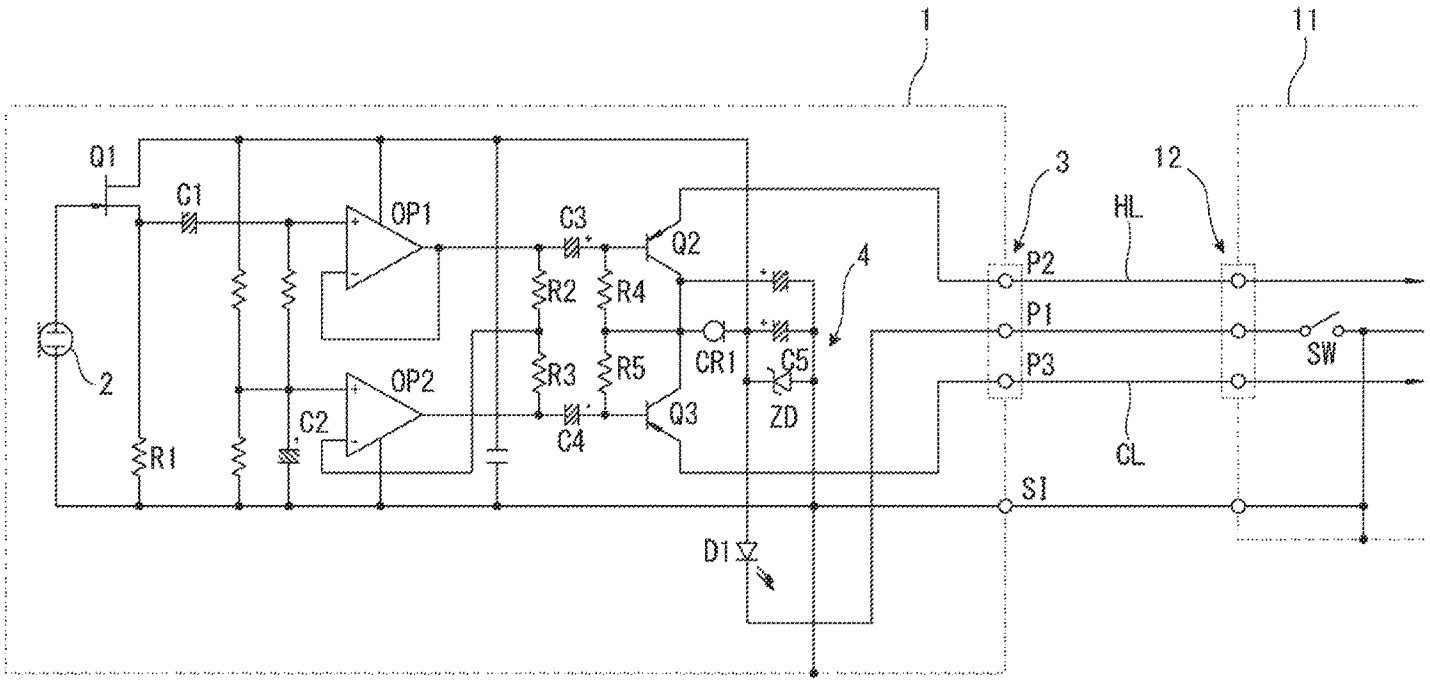
Fig. 4 Related Art
FIG. 4 is a circuit configuration diagram of a previously-proposed condenser microphone.

Members in the condenser microphone 1 illustrated in FIG. 1 having the same functions as those of the condenser microphone illustrated in FIG. 4 are denoted by the same reference numerals. The detailed description will be therefore omitted.

The condenser microphone 1 illustrated in FIG. 1 includes four LEDs (D1 to D4) connected in series as light emitters. A light emitting drive current is supplied to the four LEDs connected in series from the 3-pin type output connector 3 for a balanced signal transmission line through the current regulative diodes CR2 and CR3.

That is, the second pin P2 of the output connector 3 is connected to the anode of the current regulative diode CR2 and the third pin P3 thereof is connected with the anode of the current regulative diode CR3. The cathodes of the current regulative diodes CR2 and CR3 are commonly connected, and the commonly-connected cathodes of the current regulative diodes are connected to the anode of the leading LED (D1) of the diodes connected in series.

On the other hand, the cathode of the tailing LED (D4) of the diodes connected in series is connected to the first pin P1 of the output connector 3, and is further connected to a remote operation switch SW disposed in the microphone amplifier unit 11 with a shielded cable, connecting the output connector 3 of the condenser microphone 1 and the connector 12 of the microphone amplifier unit 11.

When the remote operation switch SW is turned ON, the LEDs (D1 to D4) connected in series are lit, and when the switch SW is turned OFF, the LEDs are lit down. The operations of lighting up and down the LEDs will be described below with reference to FIG. 2 and FIG. 3.

With the configuration of the condenser microphone 1 illustrated in FIG. 1, a light emitting drive current is supplied to the LEDs (D1 to D4) connected in series through the current regulative diodes CR2 and CR3 connected to the balanced transmission line. The audio signal processing circuit including the impedance conversion circuit of the condenser microphone 1 and the two operational amplifiers OP1 and OP2 acquires operation power from the constant voltage circuit 4 including the Zener diode ZD and the capacitor C5.

Thus, the configuration enables to prevent voltage fluctuation due to lighting up and down of the LEDs (D1-D4) to the constant voltage circuit 4. Thereby, it is possible to avoid superimpose of a noise due to the blinking LEDs (D1 to D4) to the audio signal processing circuit operating with the constant voltage circuit 4.

Figure 2:
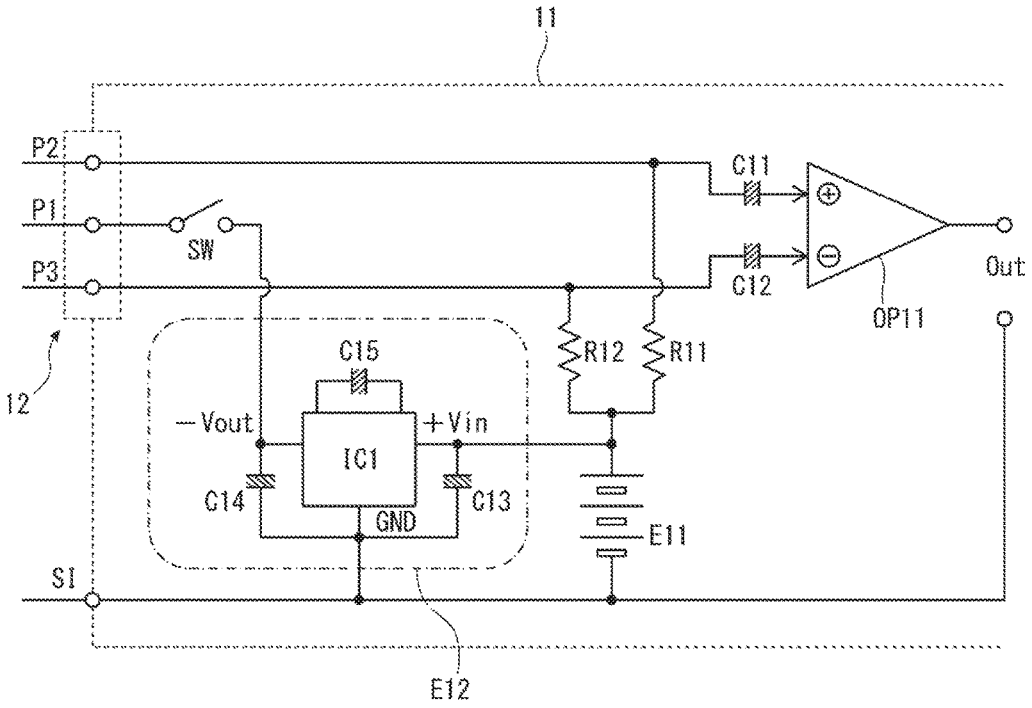
FIG. 2 is a circuit configuration diagram illustrating a first example of the phantom power supply device according to the present invention.

FIG. 2 is a circuit configuration diagram illustrating a first example of the phantom power supply device according to the present invention mounted on the microphone amplifier unit 11.

A hot second pin P2 and a cold third pin P3 of the connector 12 provided in the microphone amplifier unit 11 are connected to the DC blocking capacitors C11 and C12, respectively, and a balanced audio signal through balanced lines from the condenser microphone 1 is fed to a non-inverting input terminal and an inverting input terminal of an operational amplifier OP11 functioning as differential amplification circuit. Thereby, a differential output of the balanced audio signal appears at an output terminal Out of the operational amplifier OP11, and is amplified by a microphone amplifier (not shown).

On the other hand, the phantom power supply device except the operational amplifier OP11 in the microphone amplifier unit 11 is provided with a first DC power supply E11, and according to the present embodiment, an output voltage of the first DC power supply E11 is set at the lowest voltage of 12 V in the standard. The DC power of 12 V is usually generated from a commercial power supply, but may be supplied by an external battery depending on a facility.

A positive terminal of the first DC power supply E11 is connected to the ends of a hot supply resistor (680Ω) R11 and a cold supply resistor (680Ω) R12, and the other end of the resistor R11 is connected to the second pin P2 of the connector 12 and the other end of the resistor R12 is connected to the third pin P3 of the connector 12, respectively. A negative terminal of the first DC power supply E11 is connected to the ground line.

Thus, a supply current from the first DC power supply E11 is supplied to the condenser microphone 1 through the hot signal line (HL) and the cold signal line (CL) connecting the output connector 3 and the connector 12 illustrated in FIG. 1.

The supply current is then supplied to the constant voltage circuit 4 in the condenser microphone 1 illustrated in FIG. 1, and a drive voltage is supplied to the FET (Q1) as impedance conversion devices in the condenser microphone 1, and the first and second operational amplifiers OP1 and OP2.

The phantom power supply device illustrated in FIG. 2 is also provided with a second DC power supply E12.

The second DC power supply E12 according to the present embodiment includes a voltage converter IC (IC1) that uses an output voltage from the first DC power supply E11, and the voltage converter IC may use an inverting type charge pump "LTC3261" by LINEAR Technology in the U.S for example.

The voltage converter IC can output a negative voltage (−Vout) with reference to the IC ground line depending on an input positive voltage (+Vin). This voltage converter generates negative voltage of −12 V that is the same potential value on the basis of the input positive voltage of +12 V from the first DC power supply E11 as a standard application example.

The capacitances of the capacitors C13 and C14 at the input and output terminals of the voltage converter IC (IC1) and the charge pump capacitor C15 are selected thereby to acquire a negative voltage (−Vout) stepped down for the input positive voltage (+Vin) as needed.

Many types of voltage converter IC having the above function are actually available, and any one of them can be selected as needed.

With the circuit configuration of the phantom power supply device illustrated in FIG. 2, the negative terminal (ground line) of the first DC power supply E11 is connected to the ground (GND) of the voltage converter IC, and the positive terminal of the first DC power supply E11 is connected to the input terminal of the voltage converter IC to which the input positive voltage (+Vin) is applied. Further, the output terminal for outputting the negative voltage (−Vout) of the voltage converter IC is connected to the remote operation switch SW in series.

That is, the negative terminal (ground line) of the first DC power supply E11 is connected in series with the positive terminal of the second DC power supply E12 by the voltage converter IC in the voltage-adding manner, and the negative terminal of the second DC power supply E12 is connected with the remote operation switch SW in series.

Thus, when the remote operation switch SW is turned ON, an added voltage of the first DC power supply E11 and the second DC power supply E12 in the phantom power supply device is supplied to the LEDs (D1 to D4) connected in series mounted on the condenser microphone 1.

Therefore, even when the lowest voltage of 12 V, which is defined in the standard for phantom power supply device, is selected, for example, an enough drive voltage can be given to the LEDs (D1 to D4) connected in series mounted on the condenser microphone 1, thereby clearly lighting the LEDs with enough light emitting luminance.

Figure 3:
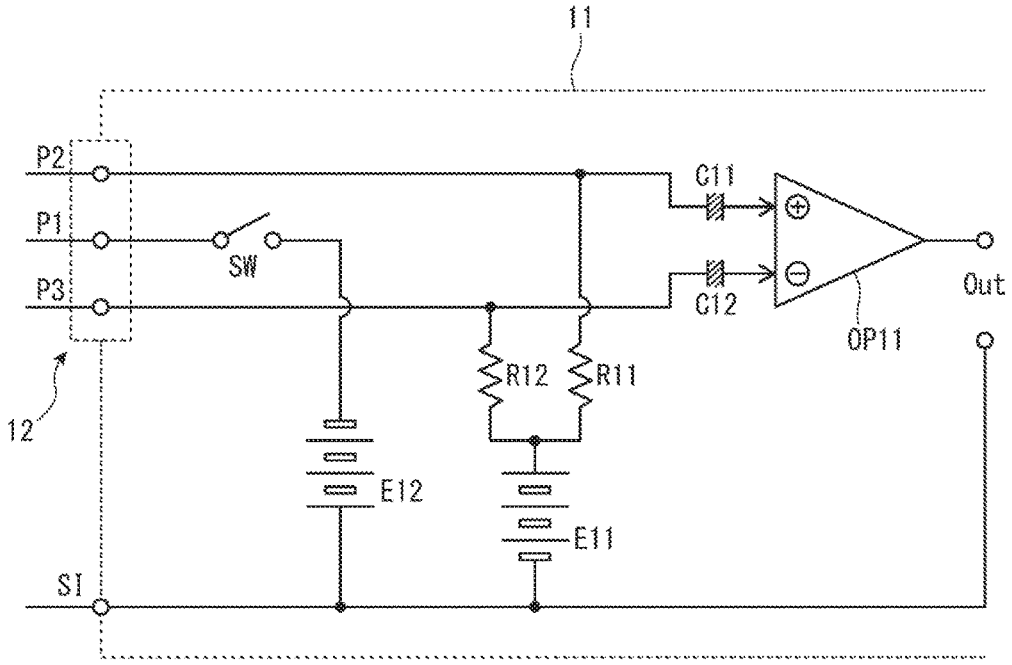
FIG. 3 is a circuit configuration diagram illustrating a second example of the phantom power supply device according to the present invention.

FIG. 3 illustrates a second example of the phantom power supply device according to the present invention. In FIG. 3, members having the same functions as those illustrated in FIG. 2 are denoted by the same reference numerals, and thus the description thereof will be omitted.

The second DC power supply E12 in the example illustrated in FIG. 3 may be generated by a commercial power supply or may be generated by an external battery depending on a facility.

The positive terminal of the second DC power supply E12 is connected to the ground line, and thus connected in series to the negative terminal of the first DC power supply E11 in the voltage-adding manner, and the negative terminal of the second DC power supply E12 is connected with the remote operation switch SW in series.

Accordingly, when the remote operation switch SW is turned ON, an added voltage of the first DC power supply E11 and the second DC power supply E12 in the phantom power supply device is supplied to the LEDs (D1 to D4) connected in series mounted on the condenser microphone 1 illustrated in FIG. 1, a basic configuration of which is the same as the example illustrated in FIG. 2.

Therefore, also in the phantom power supply device illustrated in FIG. 3, it is possible to obtain the similar operational effects to those in the example illustrated in FIG. 2.

In the condenser microphone 1 using the phantom power supply device described above, the LEDs (D1 to D4) as light emitters mounted on the condenser microphone 1 are energized through the remote operation switch SW disposed in the microphone amplifier unit 11. However, the phantom power supply device according to the present invention can supply an operation current with using the remote operation switch SW not only to the LEDs as light emitters but also to the current drive devices mounted on the condenser microphone other than the LED, thereby obtaining the similar operational effects. Any number of LEDs may be connected, and a plurality of LEDs may be connected in series. Further, as light emitting devices, other light emitting devices such as an organic light emitting diode (OLED) may be employed, not limited to LEDs.

What is claimed is:

1. A phantom power supply device for supplying power to a condenser microphone from which an audio signal is outputted through a balanced line having a hot signal line and a cold signal line, the phantom power supply device comprising:

a first DC power supply that supplies a supply current to the condenser microphone via the hot signal line and the cold signal line through a hot supply resistor and a cold supply resistor, respectively, a second DC power supply, and a remote control switch having one terminal connected to one terminal of the second DC power supply and controlling energization to a current drive device mounted on the condenser microphone, wherein an added voltage of the first DC supply and the second DC supply is supplied to the current drive device mounted on the condenser microphone by an ON operation of the remote control switch.

2. The phantom power supply device according to claim 1, wherein the second DC power supply is generated from the first DC power supply by a voltage converter IC.

3. The phantom power supply device according to claim 1, wherein the current drive device mounted on the condenser microphone is a light emitting display in which a plurality of LEDs is connected in series, and the added voltage of the first DC power supply and the second DC power supply is supplied to the LEDs connected in series when the remote operation switch is turned ON.

4. The phantom power supply device according to claim 2, wherein the current drive device mounted on the condenser microphone is a light emitting display in which a plurality of LEDs is connected in series, and the added voltage of the first DC power supply and the second DC power supply is supplied to the LEDs connected in series when the remote operation switch is turned ON.

5. The phantom power supply device according to claim 1, wherein one end of a first current regulative diode and one end of a second current regulative diode are respectively connected to the hot signal line and the cold signal line, and the other ends of the first and second current regulative diodes are commonly connected to one end of the current drive device.

* * * * *